US009805669B2

(12) United States Patent
Hasegawa

(10) Patent No.: US 9,805,669 B2
(45) Date of Patent: Oct. 31, 2017

(54) DISPLAY PANEL DRIVE DEVICE AND DISPLAY PANEL DRIVE METHOD

(71) Applicant: LAPIS Semiconductor Co., Ltd., Yokohama (JP)

(72) Inventor: Hideaki Hasegawa, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 21 days.

(21) Appl. No.: 14/717,865

(22) Filed: May 20, 2015

(65) Prior Publication Data

US 2015/0339989 A1 Nov. 26, 2015

(30) Foreign Application Priority Data

May 22, 2014 (JP) ..... 2014-106075

(51) Int. Cl.

| | |
|---|---|
| ***G09G 5/00*** | (2006.01) |
| ***G09G 3/36*** | (2006.01) |
| ***G09G 3/20*** | (2006.01) |

(52) U.S. Cl.

CPC ..... *G09G 3/3607* (2013.01); *G09G 3/20* (2013.01); *G09G 3/3659* (2013.01); *G09G 3/3674* (2013.01); *G09G 3/3685* (2013.01); *G09G 2310/0202* (2013.01); *G09G 2310/027* (2013.01); *G09G 2320/0626* (2013.01); *G09G 2330/023* (2013.01)

(58) Field of Classification Search

CPC ..... G09G 3/22; G09G 3/3208; G09G 3/30; G09G 3/3225; G09G 3/3233; G09G 3/3241; G09G 3/3266; G09G 3/3275; G09G 3/3258; G09G 2310/027

See application file for complete search history.

(56) References Cited

U.S. PATENT DOCUMENTS

| | | | | |
|---|---|---|---|---|
| 8,675,998 | B2 * | 3/2014 | Okuda | G06T 3/4007 382/260 |
| 8,976,186 | B2 * | 3/2015 | Yu | G09G 5/36 345/547 |
| 9,613,407 | B2 * | 4/2017 | Atkins | G06T 5/007 |
| 2003/0179175 | A1 * | 9/2003 | Shigeta | G09G 3/3648 345/101 |
| 2005/0057486 | A1 * | 3/2005 | Aoki | G09G 3/3406 345/102 |
| 2008/0225036 | A1 * | 9/2008 | Song | G09G 3/3611 345/213 |

(Continued)

FOREIGN PATENT DOCUMENTS

| | | |
|---|---|---|
| JP | H11-259036 A | 9/1999 |
| JP | 2006-292807 A | 10/2006 |

*Primary Examiner* — Kent Chang
*Assistant Examiner* — William Lu
(74) *Attorney, Agent, or Firm* — Rabin & Berdo, P.C.

(57) ABSTRACT

A plurality of video data pieces corresponding to one horizontal scan line of a display panel are classified into a first video data group and a second video data group different from the first video data group. Each piece of video data belonging to the first video data group is converted into a gradation voltage having an analog voltage value, and by interpolation based on each of the gradation voltages, a gradation voltage corresponding to each of the video data pieces belonging to said second video data group is obtained.

14 Claims, 9 Drawing Sheets

(56) References Cited

U.S. PATENT DOCUMENTS

| | | | | |
|---|---|---|---|---|
| 2009/0102831 | A1* | 4/2009 | Hashimoto | G09G 3/3614 345/214 |
| 2010/0033460 | A1* | 2/2010 | Numao | G09G 3/3688 345/211 |
| 2011/0187735 | A1* | 8/2011 | Kondoh | G09G 3/2003 345/589 |
| 2012/0026154 | A1* | 2/2012 | Tsuchi | G09G 3/3688 345/212 |
| 2013/0286003 | A1* | 10/2013 | Park | G06F 3/038 345/214 |
| 2015/0302789 | A1* | 10/2015 | Furihata | G09G 3/2007 345/694 |

* cited by examiner

DISPLAY PANEL DRIVE DEVICE AND DISPLAY PANEL DRIVE METHOD

BACKGROUND OF THE INVENTION

Field of the Invention

The present invention relates to a display panel drive device, and more particularly to the display drive device for applying a gradation voltage to a data line of a display panel and a display panel drive method.

Description of the Related Arts

A liquid crystal display panel as an example of a planar display panel is provided with a plurality of scan lines extending in the horizontal direction of the two-dimensional screen which intersect a plurality of data lines extending in the vertical direction of the two-dimensional screen. Electrodes serving as a display cell are formed at the intersections of the data lines and the scan lines.

The liquid crystal display panel is provided with a data driver for applying a voltage based on an input video signal to each data line. The data driver is provided for each data line with a decoder for converting display data corresponding to each pixel into a gradation voltage having a voltage value corresponding to a brightness level (for example, see Japanese Patent Application Laid-Open No. 2006-292807).

Therefore, an increase in the number of data lines for a higher resolution of the liquid crystal display panel would lead to an increase in the number of decoders, resulting in the chip size of the data driver being increased.

In this context, suggested is a data driver which is capable of driving the data lines of a liquid crystal display panel, using a less number of decoders than the number of data lines, by driving three data lines with one decoder in a timesharing manner (for example, see Japanese Patent Application Laid-Open No. Hei. 11-259036).

It is possible for the aforementioned data driver to reduce the size of the chip size. However, driving based on display data for one horizontal scan has to be carried out by being temporally divided. Thus, the operation frequency needs to be increased by the number of the divisions. Therefore, such a data driver increases the power consumption and the amount of generated heat by the increase in the operation frequency.

SUMMARY OF THE INVENTION

An object of the present invention is to provide a display panel drive device and a display panel drive method which are capable of reducing the device size, the power consumption, and the amount of generated heat.

A display panel drive device according to the present invention receives input video data each including a series of video data pieces each indicative of a brightness level of each pixel and then applies gradation voltages corresponding to each of the video data pieces to the display panel. The drive device includes a D/A converter and a gradation voltage interpolation circuit. When the plurality of video data pieces corresponding to one horizontal scan line of data of the display panel are classified into a first video data group and a second video data group different from the first video data group, the D/A converter converts each of the video data pieces belonging to the first video data group into an analog voltage as a gradation voltage corresponding to said first video data group. The gradation voltage interpolation circuit provides a gradation voltage corresponding to each of the video data pieces belonging to the second video data group by interpolation based on each of the gradation voltages generated by the D/A converter.

Furthermore, a display panel drive device according to the present invention receives input video data that has a series of video data pieces each indicative of a brightness level of each pixel and then applies a gradation voltage corresponding to each of the video data pieces to the display panel. When a plurality of pixels disposed side by side on a horizontal scan line of the display panel are classified into a first pixel group and a second pixel group different from the first pixel group, the input video data includes a plurality of video data pieces each corresponding to each of the pixels belonging to the first pixel group and pieces of gradation voltage selection data each corresponding to each of the pixels belonging to the second pixel group. The drive device includes: a D/A converter for converting each of the video data pieces each corresponding to each of the pixels belonging to the first pixel group into an analog voltage as a gradation voltage corresponding to the first pixel group; an average computation part for determining, as an average gradation voltage, an average value of a first gradation voltage generated by the D/A converter on the basis of one piece of the video data belonging to the first pixel group and a second gradation voltage generated by the D/A converter on the basis of another piece of the video data different from the one piece of the video data belonging to the first pixel group; a weighted average computation part for determining, as a weighted average gradation voltage, a weighted average of the first gradation voltage and the second gradation voltage; and a selector for selecting one of the first gradation voltage, the second gradation voltage, the average gradation voltage, and the weighted average gradation voltage on the basis of the pieces of the gradation voltage selection data corresponding to the pixels belonging to the second pixel group, and then outputting the selected voltage as the gradation voltage corresponding to the pixels belonging to the second pixel group.

Furthermore, a display panel drive method according to the present invention is a display panel drive method of receiving input video data that has a series of video data pieces each indicative of a brightness level of each pixel and then applying a gradation voltage corresponding to each of the video data pieces to a display panel. The method includes, when the plurality of video data pieces corresponding to one horizontal scan line of data of the display panel are classified into a first video data group and a second video data group different from the first video data group, converting each of the video data pieces belonging to the first video data group into a gradation voltage having an analog voltage value, and then providing, by interpolation based on each of the gradation voltages corresponding to the first video data group, the gradation voltage corresponding to each of the video data pieces belonging to the second video data group.

According to the present invention, each of video data pieces belonging only to a video data group is converted by a D/A converter into a gradation voltage having an analog voltage value, the video data group including a group of some of a plurality of video data pieces corresponding to one horizontal scan line of data of the display panel, and then by interpolation based on each of the gradation voltages, a gradation voltage is provided which corresponds to each of the video data pieces belonging to another video data group.

This makes it possible to reduce the circuit size, the power consumption, and the amount of generated heat when compared with the case where all video data pieces for one horizontal scan line are subjected to the gradation voltage conversion by the D/A converter.

DETAILED DESCRIPTION OF THE INVENTION

Figure 1:
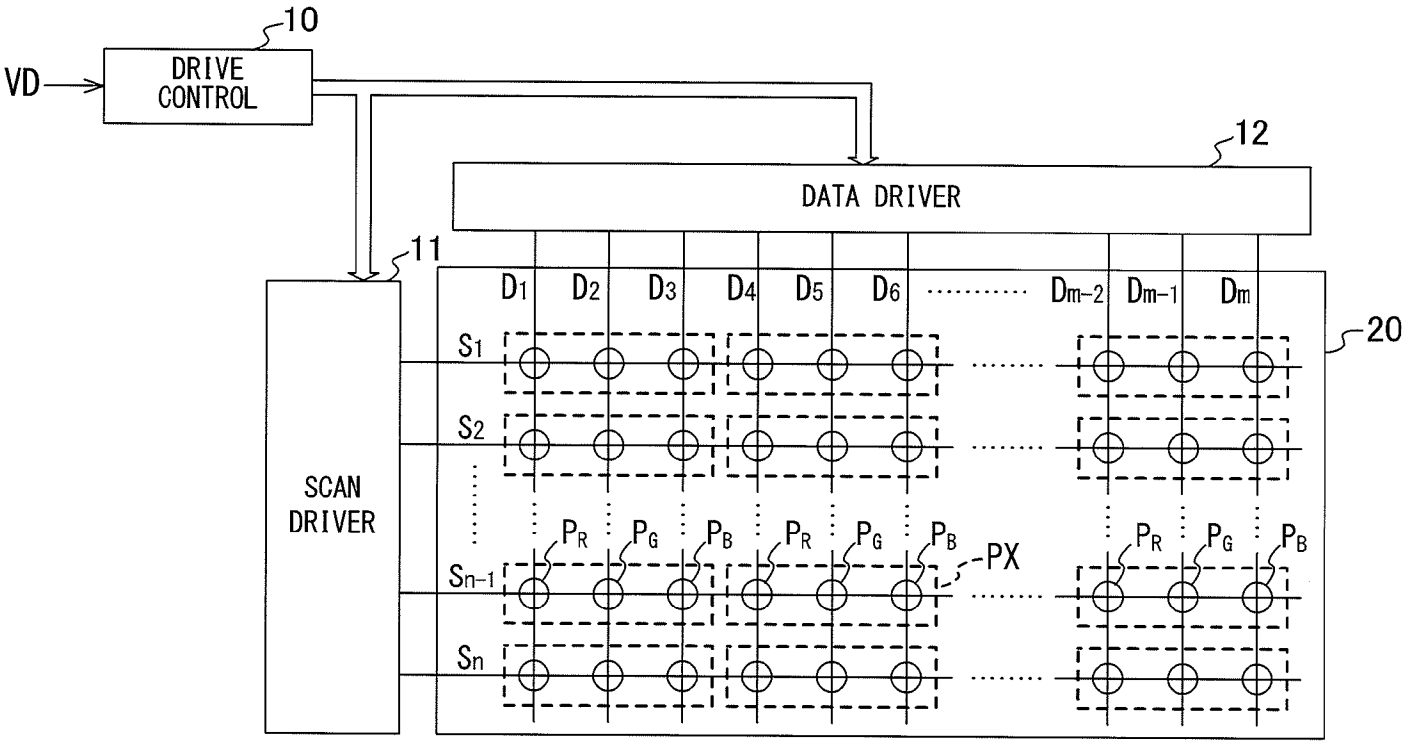
FIG. 1 is a schematic view illustrating the configuration of a display device which includes a display panel drive device according to the present invention.

FIG. 1 is a schematic view illustrating the configuration of a display device that includes a display panel drive device according to the present invention.

In FIG. 1, a display panel 20 as an example of a liquid crystal panel is provided with a liquid crystal layer (not shown), n horizontal scan lines $S_1$ to $S_n$ (n is an integer equal to two or greater) extending in the horizontal direction of the two-dimensional screen, and m data lines $D_1$ to $D_m$ (m is an integer equal to three or greater) extending in the vertical direction of the two-dimensional screen. At the intersecting regions between the horizontal scan lines and the data lines, a red display cell $P_R$ serving for red color display, a green display cell $P_G$ serving for green color display, or a blue display cell $P_B$ serving for blue color display are formed.

The red display cell $P_R$ is formed at the $(3\cdot t-2)^{th}$ data lines (t is a natural number from 1 to 320) of the data lines $D_1$ to $D_m$, that is, $D_1, D_4, D_7, \ldots$, and $D_{m-2}$. The green display cell $P_B$ is formed at the $(3\cdot t-1)^{th}$ data lines of the data lines $D_1$ to $D_m$, that is, $D_2, D_5, D_8, \ldots$, and $D_{m-1}$. The blue display cell $P_B$ is formed at the $(3\cdot t)^{th}$ data lines of the data lines $D_1$ to $D_m$, that is, $D_3, D_6, D_9, \ldots$ and $D_m$.

As shown in FIG. 1, on each of the horizontal scan lines $S_1$ to $S_n$, the three display cells adjacent to each other, that is, the red display cell $P_R$, the green display cell $P_G$, and the blue display cell $P_B$ form one pixel PX (the region surrounded by broken lines). On one horizontal scan line, (m/3) pixels PX are disposed side by side.

A drive control part 10 generates a scan control signal in synchronization with input video data VD, and the scan control signal is then supplied to a scan driver 11. The input video data VD includes a series of video data pieces each indicative of the brightness level corresponding to each pixel. One pixel PX is associated with three video data pieces: a piece of video data which represents the brightness level of the red component in eight bits; a piece of video data which represents the brightness level of the green color component in eight bits; and a piece of video data which represents the brightness level of the blue component in eight bits.

On the basis of the input video data VD, the drive control part 10 supplies to a data driver 12, for each pixel, video data PD serving as the video data pieces which represent the brightness level of each of the red display cell $P_R$, the green display cell $P_G$, and the blue display cell $P_B$ corresponding to the pixel, for example, in eight bits.

The scan driver 11 generates scanning pulses in response to the scan control signal supplied from the drive control part 10, and the scanning pulses are then sequentially selectively applied to the horizontal scan lines $S_1$ to $S_n$ of the display panel 20.

The data driver 12 captures the series of video data PD supplied from the drive control part 10. Each time one horizontal scan line of data is captured, that is, m pieces of video data $PD_1$ to $PD_m$ are captured, the data driver 12 generates pixel drive voltages $G_1$ to $G_m$ having a gradation voltage corresponding to the brightness level indicated by each piece of video data PD, and then applies the pixel drive voltages $G_1$ to $G_m$ to the respectively corresponding data lines $D_1$ to $D_m$.

Figure 2:
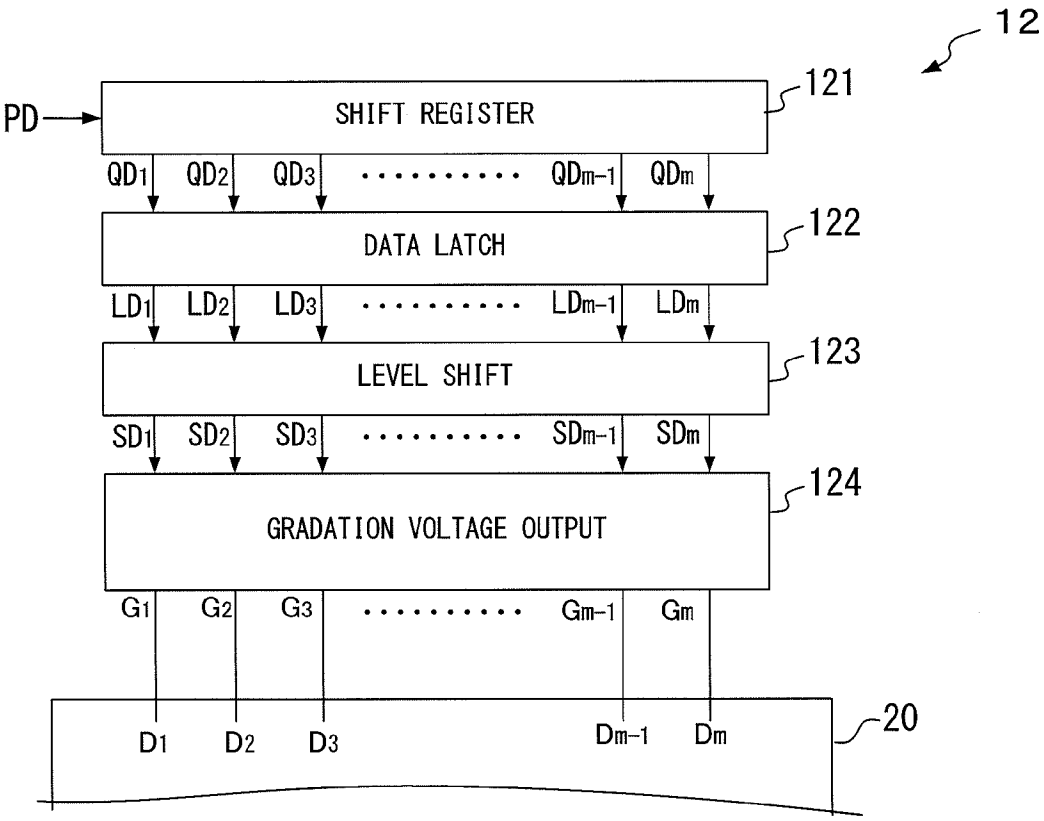
FIG. 2 is a block diagram illustrating the internal configuration of a data driver 12.

FIG. 2 is a block diagram illustrating the internal configuration of the data driver 12.

Figure 3:
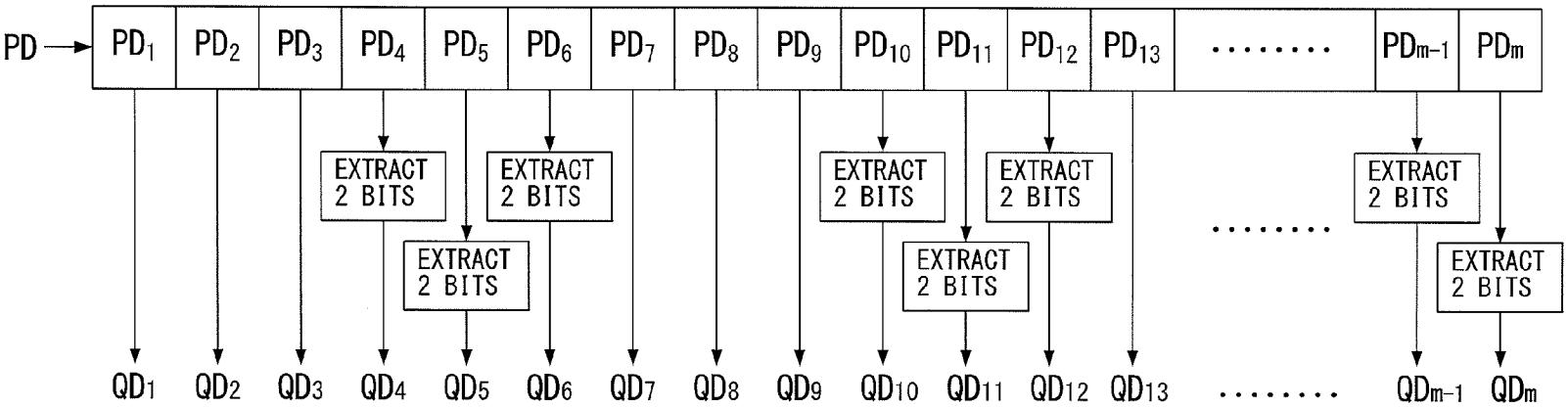
FIG. 3 is a view illustrating an example of the operation of a shift register 121.

The series of video data PD supplied from the drive control part 10 is sequentially captured by a shift register 121. As shown in FIG. 3, each time one horizontal scan line of video data $PD_1$ to $PD_m$ is completely captured, the shift register 121 supplies the video data $QD_1$ to $QD_m$ a data latch part 122. The $(3\cdot t-2)^{th}$ video data PD of the video data $PD_1$ to $PD_m$ represents the red brightness component, for example, in eight bits. The $(3\cdot t-1)^{th}$ video data PD represents the green brightness component, for example, in eight bits. The $(3\cdot t)^{th}$ video data PD represents the blue brightness component, for example, in eight bits.

As shown in FIG. 3, for the $(6\cdot t-5)^{th}$, $(6\cdot t-4)^{th}$, and $(6\cdot t-3)^{th}$ video data PD of the video data $PD_1$ to $PD_m$ (a first video data group), the shift register 121 supplies the eight-bit data expressed by the video data PD to the data latch part 122 as video data QD with no change made thereto. That is, for the video data PD corresponding to the odd-numbered pixel PX, the shift register 121 supplies the video data PD to the data latch part 122 as the video data QD with no change made thereto.

For the $(6\cdot t-2)^{th}$, the $(6\cdot t-1)^{th}$, and the $(6\cdot t)^{th}$ video data PD of the video data $PD_1$ to $PD_m$ (a second video data group), the shift register 121 extracts, for example, the lower two bits from the video data PD and then supplies the extracted video data QD of the two bits to the data latch part 122. That is, the shift register 121 extracts the lower two bits from each video data PD corresponding to the even-numbered pixel PX of the (m/3) pixels PX disposed side by side on one horizontal scan line of the display panel 20, and then supplies each the extracted two-bit video data QD to the data latch part 122.

For example, the shift register 121 acquires the video data $QD_4$ to $QD_6$ below from the video data $PD_4$ to $PD_6$ corresponding to the second pixel PX arranged on one horizontal scan line, and then supplies the video data $QD_4$ to $QD_6$ to the data latch part 122. That is, the shift register 121 supplies, to the data latch part 122, the video data $QD_4$ made up of the lower two bits of the video data $PD_4$, the video data $QD_5$ made up of the lower two bits of the video data $PD_5$, and the video data $QD_6$ made up of the lower two bits of the video data $PD_6$.

The data latch part 122 captures the video data $QD_1$ to $QD_m$ supplied from the shift register 121, and while sustaining the video data $QD_1$ to $QD_m$ for one horizontal scan period, supplies each piece of the video data $QD_1$ to $QD_m$ to a level shift part 123 as video data $LD_1$ to $LD_m$.

The level shift part 123 supplies, to a gradation voltage output part 124, video data $SD_1$ to $SD_m$ obtained by shifting the level of the value of each of the video data $LD_1$ to $LD_m$ by a predetermined level.

The gradation voltage output part 124 converts the video data $SD_1$ to $SD_m$ into gradation voltages $G_1$ to $G_m$ individually corresponding to the brightness level represented by the video data, and then applies the gradation voltages $G_1$ to $G_m$ to the data lines $D_1$ to $D_m$ of the display panel 20.

Figure 4:
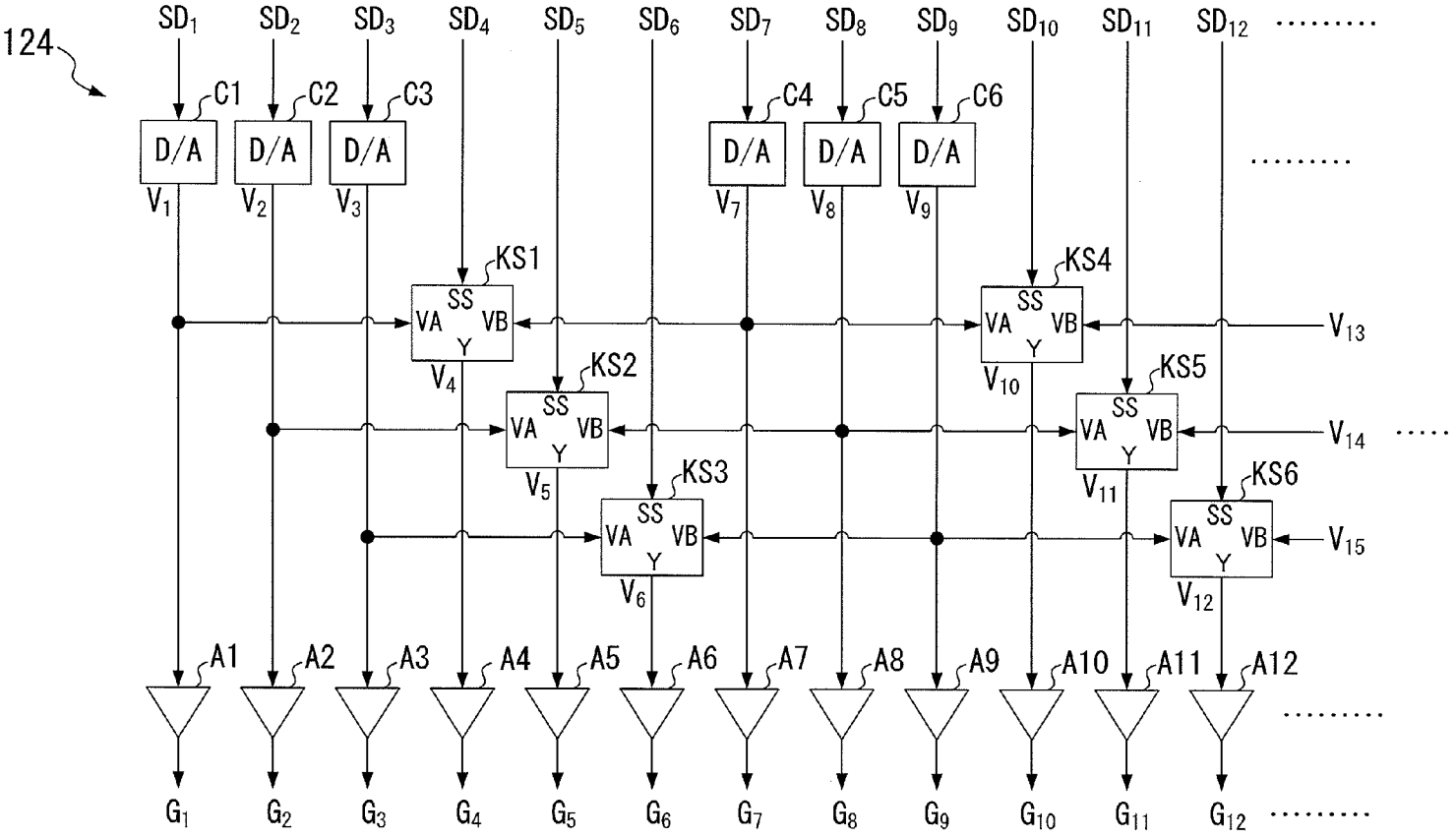
FIG. 4 is a block diagram illustrating an example of the internal configuration of a gradation voltage output part 124.

FIG. 4 is a block diagram illustrating the internal configuration of the gradation voltage output part 124.

Note that FIG. 4 illustrates only those excerpted functional modules, which relate to the video data $SD_1$ to $SD_{12}$, among all the functional modules that constitute the gradation voltage output part 124.

In FIG. 4, a D/A converter C1 converts the video data $SD_1$ into a gradation voltage corresponding to the brightness level represented by the video data $SD_1$, and then supplies the gradation voltage as a gradation voltage $V_1$ to an amplifier A1 and an input end VA of a gradation voltage interpolation circuit KS1.

A D/A converter C2 converts the video data $SD_2$ into an analog gradation voltage corresponding to the brightness level represented by the video data $SD_2$, and then supplies the analog gradation voltage as a gradation voltage $V_2$ to an amplifier A2 and an input end VA of a gradation voltage interpolation circuit KS2.

A D/A converter C3 converts the video data $SD_3$ into an analog gradation voltage corresponding to the brightness level represented by the video data $SD_3$, and then supplies the analog gradation voltage as a gradation voltage $V_3$ to an amplifier A3 and an input end VA of a gradation voltage interpolation circuit KS3.

A D/A converter C4 converts the video data $SD_7$ into an analog gradation voltage corresponding to the brightness level represented by the video data $SD_7$, and then supplies the analog gradation voltage as a gradation voltage $V_7$ to an amplifier A7, an input end VB of the gradation voltage interpolation circuit KS1, and an input end VA of a gradation voltage interpolation circuit KS4.

A D/A converter C5 converts the video data $SD_8$ into an analog gradation voltage corresponding to the brightness level represented by the video data $SD_8$, and then supplies the analog gradation voltage as a gradation voltage $V_8$ to an amplifier A8, an input end VB of the gradation voltage interpolation circuit KS2, and an input end VA of a gradation voltage interpolation circuit KS5.

A D/A converter C6 converts the video data $SD_9$ into an analog gradation voltage corresponding to the brightness level represented by the video data $SD_9$, and then supplies the analog gradation voltage as a gradation voltage $V_9$ to an amplifier A9, an input end VB of the gradation voltage interpolation circuit KS3, and an input end VA of a gradation voltage interpolation circuit KS6.

The gradation voltage interpolation circuits KS1 to KS6 have the same internal configuration.

Figure 5:
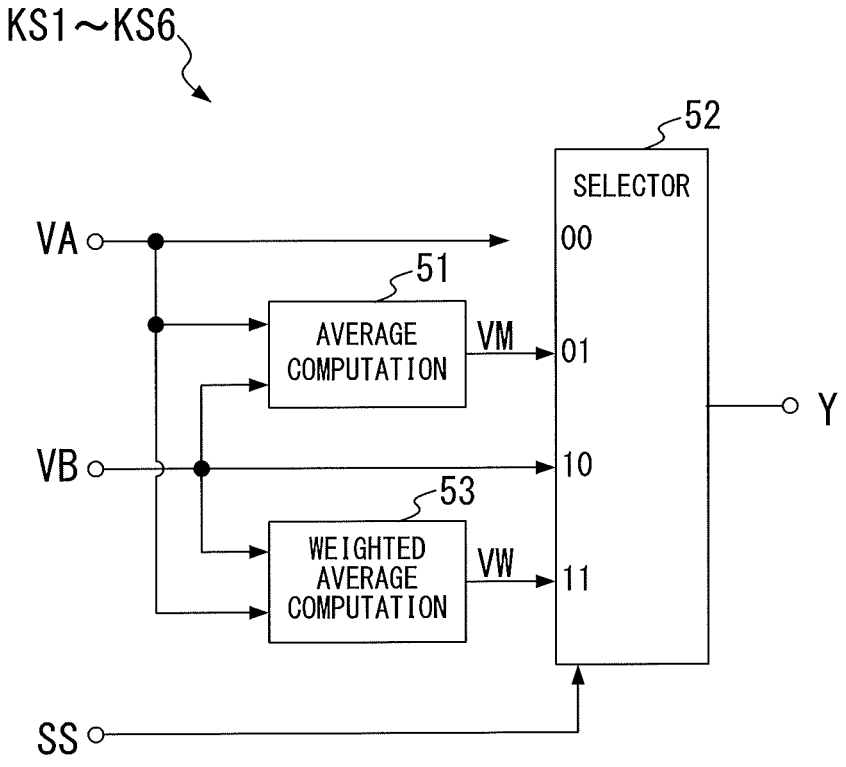
FIG. 5 is a block diagram illustrating an example of the internal configuration of each of gradation voltage interpolation circuits KS1 to KS6.

FIG. 5 is a block diagram illustrating the internal configuration of each of the gradation voltage interpolation circuits KS1 to KS6.

In FIG. 5, an average computation part 51 computes an average value of the gradation voltage supplied to the input end VA and the gradation voltage supplied to the input end VB, and then supplies an average gradation voltage VM indicative of the average value to a selector 52. A weighted average computation part 53 provides mutually different weights to the gradation voltage supplied to the input end VA and the gradation voltage supplied to the input end VB to compute the weighted average value, and then supplies a weighted average gradation voltage VW indicative of the weighted average value to the selector 52.

On the basis of the two-bit video data supplied to a selection control end SS, the selector 52 selects one of the gradation voltage supplied to the input end VA, the gradation voltage supplied to the input end VB, the average gradation voltage VM, and the weighted average gradation voltage VW, and then outputs the selected voltage via an output end Y.

For example, when the two-bit video data supplied to the selection control end SS is indicative of [00], the selector 52 selects the gradation voltage supplied to the input end VA and then outputs the selected gradation voltage via the output end Y. When the video data is indicative of [01], the selector 52 selects the average gradation voltage VM and then outputs the average gradation voltage VM via the output end Y. When the video data is indicative of [10], the selector 52 selects the gradation voltage supplied to the input end VB and then outputs the selected gradation voltage via the output end Y. When the video data is indicative of [11], the selector 52 selects the weighted average gradation voltage VW based on the gradation voltages supplied to the respective input ends VA and VB and then outputs the weighted average gradation voltage VW via the output end Y.

A description will next be made to the operation of each of the gradation voltage interpolation circuits KS1 to KS6 having the internal configuration shown in FIG. 5.

On the basis of the video data $SD_4$ supplied to the selection control end SS, the gradation voltage interpolation circuit KS1 selects one of the gradation voltage $V_1$ produced at the D/A converter C1, the gradation voltage $V_7$ produced at the D/A converter C4, the average gradation voltage VM based on $V_1$ and $V_7$, and the weighted average gradation voltage VW based on $V_1$ and $V_7$, and then supplies the selected voltage to an amplifier A4 as a gradation voltage $V_4$.

On the basis of the video data $SD_5$ supplied to the selection control end SS, the gradation voltage interpolation circuit KS2 selects one of the gradation voltage $V_2$ produced at the D/A converter C2, the gradation voltage $V_8$ produced at the D/A converter C5, the average gradation voltage VM based on $V_2$ and $V_8$, and the weighted average gradation voltage VW based on $V_2$ and $V_8$, and then supplies the selected voltage to an amplifier A5 as an gradation voltage $V_5$.

On the basis of the video data $SD_6$ supplied to the selection control end SS, the gradation voltage interpolation circuit KS3 selects one of the gradation voltage $V_3$ produced at the D/A converter C3, the gradation voltage $V_9$ produced at the D/A converter C6, the average gradation voltage VM based on $V_3$ and $V_9$, and the weighted average gradation voltage VW based on $V_3$ and $V_9$, and then supplies the selected voltage to an amplifier A6 as a gradation voltage $V_6$.

On the basis of the video data $SD_{10}$ supplied to the selection control end SS, the gradation voltage interpolation circuit KS4 selects one of the gradation voltage $V_7$ produced at the D/A converter C4, a gradation voltage $V_{13}$, the average gradation voltage VM based on $V_7$ and $V_{13}$, and the weighted average gradation voltage VW based on $V_7$ and $V_{13}$, and then supplies the selected voltage to an amplifier A10 as a gradation voltage $V_{10}$. Note that the gradation voltage $V_{13}$ is produced by a D/A converter (not shown) for converting the video data $SD_{13}$ into an analog gradation voltage.

On the basis of the video data $SD_{13}$ supplied to the selection control end SS, the gradation voltage interpolation circuit KS5 selects one of the gradation voltage $V_8$ produced at the D/A converter C5, a gradation voltage $V_{14}$, the average gradation voltage VM based on $V_8$ and $V_{14}$, and the weighted average gradation voltage VW based on $V_8$ and $V_{14}$, and then supplies the selected voltage to an amplifier A11 as a gradation voltage $V_{11}$. Note that the gradation voltage $V_{14}$ is produced by a D/A converter (not shown) for converting video data $SD_{14}$ into an analog gradation voltage.

On the basis of the video data $SD_{12}$ supplied to the selection control end SS, the gradation voltage interpolation circuit KS6 selects one of the gradation voltage $V_9$ produced at the D/A converter C6, a gradation voltage $V_{15}$, the average gradation voltage VM based on $V_9$ and $V_{15}$, and the weighted average gradation voltage VW based on $V_9$ and $V_{15}$, and then supplies the selected voltage as a gradation voltage $V_{12}$ to an amplifier A12. Note that the gradation voltage $V_{15}$ is produced by a D/A converter (not shown) for converting video data $SD_{15}$ into an analog gradation voltage.

The amplifiers A1 to A12 apply, to the data lines $D_1$ to $D_{12}$ of the display panel 20, gradation voltages $G_1$ to $G_{12}$ obtained by individually amplifying the gradation voltages $V_1$ to $V_{12}$ supplied from the D/A converters C1 to C6 and the gradation voltage interpolation circuits KS1 to KS6. Note that each of the amplifiers A1 to A12 to be employed may also be a voltage follower circuit with an operational amplifier.

As described above, as a function block for converting the video data $SD_{13}$ to $SD_m$ into the gradation voltages $G_{13}$ to $G_m$, the gradation voltage output part 124 is provided, in the same manner as in FIG. 4, with the same function block as that of the D/A converters C1 to C6, the gradation voltage interpolation circuits KS1 to KS6, and the amplifiers A1 to A12.

As described above, the gradation voltage output part 124 allows the D/A converter to perform the gradation voltage conversion only on the video data SD corresponding to the odd-numbered pixels PX of the (m/3) pixels PX disposed side by side along one horizontal scan line of the display panel 20. That is, the gradation voltage output part 124 classifies a plurality of video data pieces corresponding to one horizontal scan line of the display panel into the first video data group (for example, $SD_1$ to $SD_3$ and $SD_7$ to $SD_9$) and the second video data group (for example, $SD_4$ to $SD_6$ and $SD_{10}$ to $SD_{12}$) which is different from the first video data group. Then, the D/A converters (C1 to C6) are used to convert only the video data pieces belonging to the first video data group into the gradation voltages (for example, $V_1$ to $V_3$ and $V_7$ to $V_9$) having an analog voltage value.

On the other hand, in the gradation voltage output part 124, by the interpolation based on each of the gradation voltages produced at the D/A converters, the gradation voltage interpolation circuits (for example, KS1 to KS6) acquire the gradation voltages ($V_4$ to $V_6$ and $V_{10}$ to $V_{12}$) each corresponding to each of the video data pieces belonging to the second video data group.

More specifically, the average computation part (51) of the gradation voltage interpolation circuit determines, as the average gradation voltage (VM), the average value of a first gradation voltage (for example, $V_1$) generated by the D/A converter on the basis of one piece of video data (for example, $SD_1$) of the video data pieces belonging to the first video data group and a second gradation voltage (for example, $V_7$) generated by the D/A converter on the basis of another piece of video data (for example, $SD_7$) belonging to the first video data group. The weighted average computation part (53) of the gradation voltage interpolation circuit determines the weighted average of the first gradation voltage and the second gradation voltage, which have been mentioned above, as the weighted average gradation voltage (VW). Then, on the basis of a piece of video data (for example, $SD_4$) belonging to the second video data group, the selector (52) of the gradation voltage interpolation circuit selects one of the first gradation voltage, the second gradation voltage, the average gradation voltage, and the weighted average gradation voltage, which have been mentioned above, and then outputs the selected voltage as the gradation voltage (for example, $V_4$) corresponding to the piece of video data belonging to the second video data group.

The circuit size and the power consumption of the gradation voltage interpolation circuits (KS1 to KS6) are less than the circuit size and the power consumption of the D/A converters (C1 to C6).

Therefore, according to the configuration shown in FIG. 4, it is possible to reduce the circuit size, the power consumption, and the amount of generated heat when compared with the case where the D/A converters perform the gradation voltage conversion on all the pieces of video data $SD_1$ to $SD_m$ of one horizontal scan line.

Furthermore, in the aforementioned configuration, since the video data pieces corresponding to even-numbered pixels PX (for example, $SD_4$ to $SD_6$ and $SD_{10}$ to $SD_{12}$) have two bits, the circuit size and the power consumption of the data latch part 122 and the level shift part 123 are reduced.

Furthermore, the aforementioned configuration allows the gradation voltages $G_1$ to $G_m$ corresponding to one horizontal scan line of video data $PD_1$ to $PD_m$ to be simultaneously applied to the data lines $D_1$ to $D_m$ of the display panel 20. Therefore, it is possible to reduce the operation frequency as compared with the case where the gradation voltage is applied in a timesharing manner within a horizontal scan period.

As described above, the data driver 12 according to this embodiment makes it possible to reduce the device size, the power consumption, and the amount of generated heat.

Figure 6:
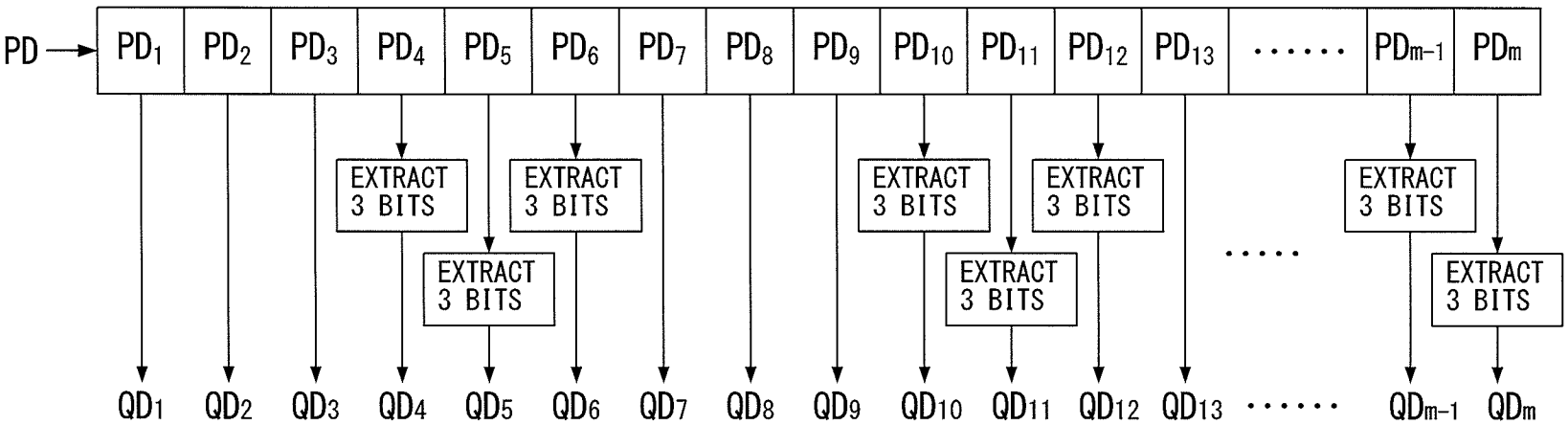
FIG. 6 is a view illustrating another example of the operation of a shift register 121.

Note that in the aforementioned embodiment, as shown in FIG. 3, the shift register 121 extracts the lower two bits from the video data PD corresponding to the even-numbered pixel PX and then supplies the video data QD of the two bits to the data latch part 122. However, the number of bits to be extracted from the video data PD is not limited to two bits. For example, as shown in FIG. 6, the shift register 121 may also extract the lower three bits from the video data PD corresponding to the even-numbered pixel PX and then apply the video data QD of the three bits to the data latch part 122. At this time, for example, the configuration shown in FIG. 7 may be employed as each of the gradation voltage interpolation circuits KS1 to KS6 corresponding to the three-bit video data QD.

Figure 7:
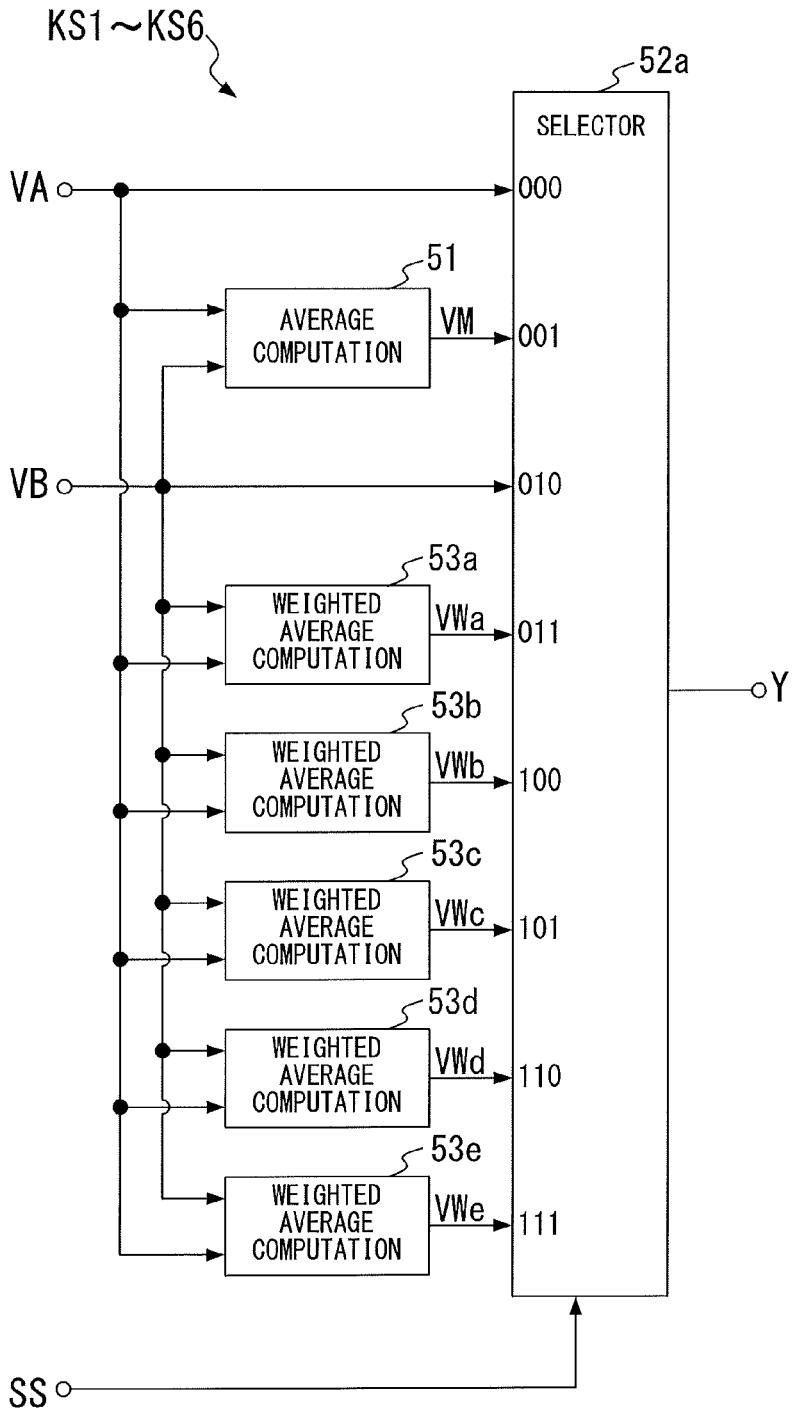
FIG. 7 is a block diagram illustrating another example of the internal configuration of each of the gradation voltage interpolation circuits KS1 to KS6.

In FIG. 7, the average computation part 51 computes the average value of the gradation voltage supplied to the input end VA and the gradation voltage supplied to the input end VB, and then supplies, to the selector 52*a*, the average gradation voltage VM indicative of the average value.

The weighted average computation part 53*a* computes an average value of a first multiplication result acquired by multiplying the gradation voltage supplied to the input end VA by a coefficient (for example 0.2) and a second multiplication result acquired by multiplying the gradation voltage supplied to the input end VB by a coefficient (for example 0.8), and then supplies, to the selector 52*a*, the weighted average gradation voltage VWa indicative of the average value.

The weighted average computation part 53*b* computes an average value of a first multiplication result acquired by multiplying the gradation voltage supplied to the input end VA by a coefficient (for example 0.3) and a second multiplication result acquired by multiplying the gradation voltage supplied to the input end VB by a coefficient (for example 0.7), and then supplies, to the selector 52*a*, the weighted average gradation voltage VWb indicative of the average value.

The weighted average computation part 53*c* computes an average value of a first multiplication result acquired by multiplying the gradation voltage supplied to the input end VA by a coefficient (for example 0.4) and a second multiplication result acquired by multiplying the gradation voltage supplied to the input end VB by a coefficient (for example 0.6), and then supplies, to the selector 52*a*, the weighted average gradation voltage VWc indicative of the average value.

The weighted average computation part 53*d* computes an average value of a first multiplication result acquired by multiplying the gradation voltage supplied to the input end VA by a coefficient (for example 0.6) and a second multiplication result acquired by multiplying the gradation voltage supplied to the input end VB by a coefficient (for example 0.4), and then supplies, to the selector 52*a*, the weighted average gradation voltage VWd indicative of the average value.

The weighted average computation part 53*e* computes an average value of a first multiplication result acquired by multiplying the gradation voltage supplied to the input end VA by a coefficient (for example 0.8) and a second multiplication result acquired by multiplying the gradation voltage supplied to the input end VB by a coefficient (for example 0.2), and then supplies, to the selector 52*a*, the weighted average gradation voltage VWe indicative of the average value.

On the basis of the 3-bit video data supplied to the selection control end SS, the selector 52*a* selects one of the gradation voltage supplied to the input end VA, the gradation voltage supplied to the input end VB, the average gradation voltage VM, and the weighted average gradation voltages VWa to VWd, and then outputs the selected voltage via the output end Y.

For example, when the 3-bit video data supplied to the selection control end SS is indicative of [000], the selector 52*a* selects the gradation voltage supplied to the input end VA, and then outputs the selected voltage via the output end Y. Furthermore, when the video data is indicative of [001], the selector 52*a* selects the average gradation voltage VM, and then outputs the average gradation voltage VM via the output end Y. Furthermore, when the video data is indicative of [010], the selector 52*a* selects the gradation voltage supplied to the input end VB, and then outputs the selected voltage via the output end Y. Furthermore, when the video data is indicative of [011], the selector 52*a* selects the weighted average gradation voltage VWa, and then outputs the weighted average gradation voltage VWa via the output end Y. Furthermore, when the video data is indicative of [100], the selector 52*a* selects the weighted average gradation voltage VWb, and then outputs the weighted average gradation voltage VWb via the output end Y. Furthermore, when the video data is indicative of [101], the selector 52*a* selects the weighted average gradation voltage VWc, and then outputs the weighted average gradation voltage VWc via the output end Y. Furthermore, when the video data is indicative of [110], the selector 52*a* selects the weighted average gradation voltage VWd, and then outputs the weighted average gradation voltage VWd via the output end Y. Furthermore, when the video data is indicative of [111], the selector 52*a* selects the weighted average gradation voltage VWe, and then outputs the weighted average gradation voltage VWe via the output end Y.

Therefore, the configuration shown in FIG. 7 includes five types of weighted average gradation voltages, i.e., the five systems of the weighted average gradation voltages VWa to VWe, and thus, can provide a gradation voltage with high accuracy when compared with the configuration which employs one system of the weighted average gradation voltage VW as shown in FIG. 5.

In the aforementioned embodiment, the D/A converter is used to perform the gradation voltage conversion only on the video data SD corresponding to the odd-numbered pixel PX to generate a gradation voltage, and then on the basis of the gradation voltage, provides the gradation voltage corresponding to the even-numbered pixel PX. However, it may also be acceptable to perform the gradation voltage conversion using the D/A converter only on the video data SD corresponding to the even-numbered pixel PX to generate a gradation voltage, and then on the basis of the gradation voltage, provide the gradation voltage corresponding to the odd-numbered pixel PX.

The aforementioned embodiment is configured to perform the gradation voltage conversion using the D/A converter only on the video data SD corresponding to the even-numbered or odd-numbered pixels PX on one horizontal scan line, that is, the pixels PX that are alternately disposed on one horizontal scan line.

However, it may also be acceptable to perform the gradation voltage conversion using the D/A converter only on the video data SD (the first video data group) corresponding to the pixels PX that are disposed at intervals of k (k is a natural number) on one horizontal scan line. At this time, by the interpolation based on each gradation voltage generated by the D/A converter, the gradation voltage corresponding to another piece of video data SD (the second video data group) is provided.

Figure 8:
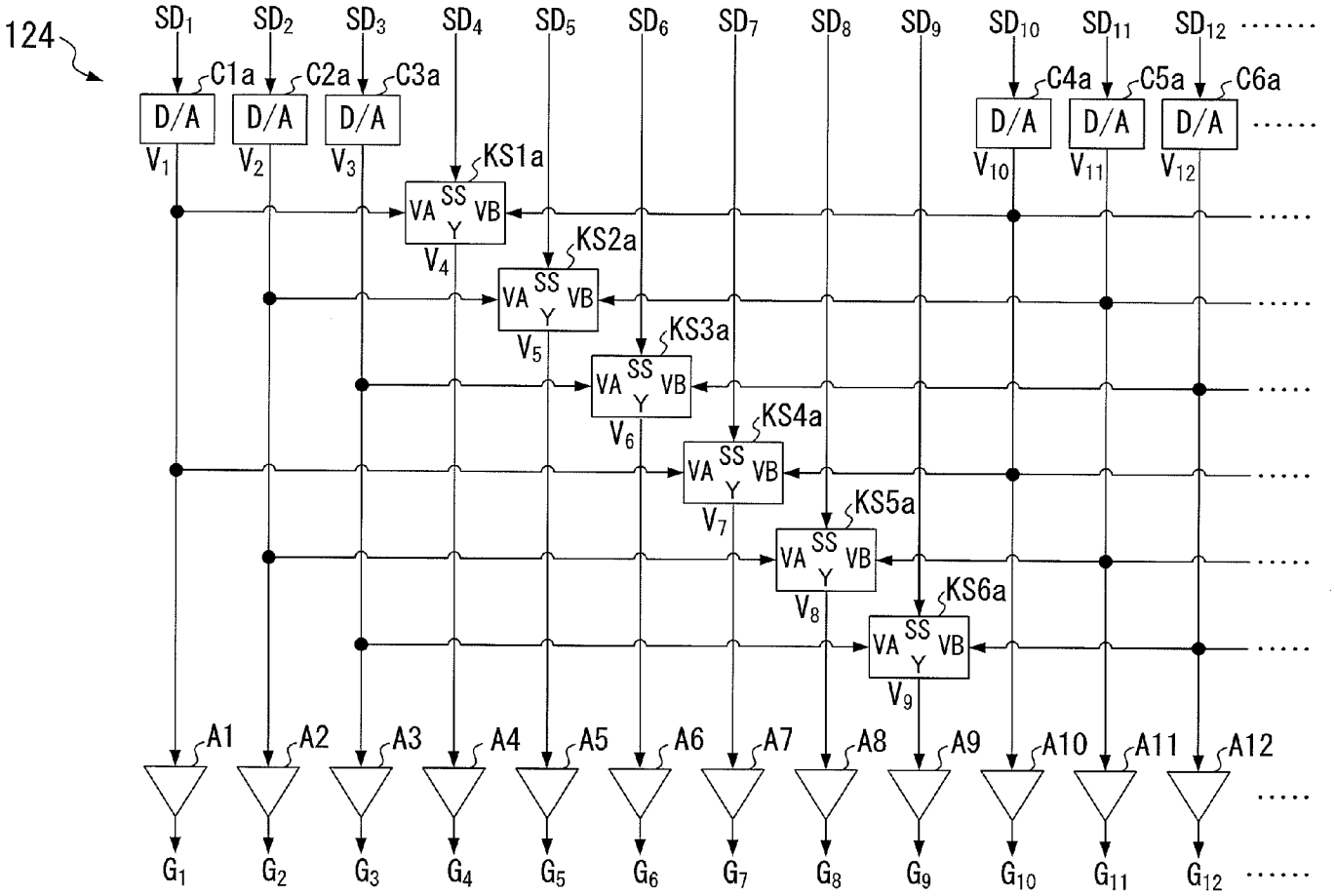
FIG. 8 is a block diagram illustrating another example of the internal configuration of a gradation voltage output part 124.

FIG. 8 is a block diagram illustrating another configuration of the gradation voltage output part 124 developed in view of such an aspect.

In FIG. 8, a D/A converter C1*a* converts the video data $SD_1$ into a gradation voltage corresponding to the brightness level represented by the 8-bit data, and then supplies the converted gradation voltage as the gradation voltage $V_1$ to the input end VA of each of gradation voltage interpolation circuits KS1*a* and KS4*a* and the amplifier A1.

The D/A converter C2*a* converts the video data $SD_2$ into an analog gradation voltage corresponding to the brightness level represented by the 8-bit data, and then supplies the converted analog gradation voltage as the gradation voltage $V_2$ to the input end VA of each of gradation voltage interpolation circuits KS2*a* and KS5*a* and the amplifier A2.

The D/A converter C3*a* converts the video data $SD_3$ into an analog gradation voltage corresponding to the brightness level represented by the 8-bit data, and then supplies the converted analog gradation voltage as the gradation voltage $V_3$ to the input end VA of each of gradation voltage interpolation circuits KS3*a* and KS6*a* and the amplifier A3.

The D/A converter C4*a* converts the video data $SD_{10}$ into an analog gradation voltage corresponding to the brightness level represented by the 8-bit data, and then supplies the converted analog gradation voltage as the gradation voltage $V_{10}$ to the input end VB of each gradation voltage interpolation circuits KS1*a* and KS4*a* and the amplifier A10.

The D/A converter C5*a* converts the video data $SD_{11}$ into an analog gradation voltage corresponding to the brightness level represented by the 8-bit data, and then supplies the converted analog gradation voltage as the gradation voltage $V_{11}$ to the input end VB of each of gradation voltage interpolation circuits KS2*a* and KS5*a* and the amplifier A11.

The D/A converter C6*a* converts the video data $SD_{12}$ into an analog gradation voltage corresponding to the brightness level represented by the 8-bit data, and then supplies the converted analog gradation voltage as the gradation voltage $V_{12}$ to the input end VB of each of gradation voltage interpolation circuits KS3*a* and KS6*a* and the amplifier A12.

Each of the gradation voltage interpolation circuits KS1*a* to KS6*a* has, for example, the configuration shown in FIG. 5 or FIG. 7.

On the basis of the video data $SD_4$ supplied to the selection control end SS, the gradation voltage interpolation circuit KS1*a* selects one of the gradation voltage $V_1$ generated at the D/A converter C1*a*, the gradation voltage $V_{10}$ generated at the D/A converter C4*a*, the average gradation voltage VM based on $V_1$ and $V_{10}$, and the weighted average gradation voltage VW based on $V_1$ and $V_{10}$, and then supplies the selected voltage to the amplifier A4 as the gradation voltage $V_4$.

On the basis of the video data $SD_5$ supplied to the selection control end SS, the gradation voltage interpolation circuit KS2*a* selects one of the gradation voltage $V_2$ generated at the D/A converter C2*a*, the gradation voltage $V_{11}$ generated at the D/A converter C5*a*, the average gradation voltage VM based on $V_2$ and $V_{11}$, and the weighted average gradation voltage VW based on $V_2$ and $V_{11}$, and then supplies the selected voltage to the amplifier A5 as the gradation voltage $V_5$.

On the basis of the video data $SD_6$ supplied to the selection control end SS, the gradation voltage interpolation circuit KS3*a* selects one of the gradation voltage $V_3$ generated at the D/A converter C3*a*, the gradation voltage $V_{12}$ generated at the D/A converter C6*a*, the average gradation voltage VM based on $V_3$ and $V_{12}$, and the weighted average gradation voltage VW based on $V_3$ and $V_{12}$, and then supplies the selected voltage to the amplifier A6 as the gradation voltage $V_6$.

On the basis of the video data $SD_7$ supplied to the selection control end SS, the gradation voltage interpolation circuit KS4*a* selects one of the gradation voltage $V_1$ generated at the D/A converter C1*a*, the gradation voltage $V_{10}$ generated at the D/A converter C4*a*, the average gradation voltage VM based on $V_1$ and $V_{10}$, and the weighted average gradation voltage VW based on $V_1$ and $V_{10}$, and then supplies the selected voltage to the amplifier A7 as the gradation voltage $V_7$.

On the basis of the video data $SD_8$ supplied to the selection control end SS, the gradation voltage interpolation circuit KS5*a* selects one of the gradation voltage $V_2$ generated at the D/A converter C2*a*, the gradation voltage $V_{11}$ generated at the D/A converter C5*a*, the average gradation voltage VM based on $V_2$ and $V_{11}$, and the weighted average gradation voltage VW based on $V_2$ and $V_{11}$, and then supplies the selected voltage to the amplifier A8 as the gradation voltage $V_8$.

On the basis of the video data $SD_9$ supplied to the selection control end SS, the gradation voltage interpolation circuit KS6*a* selects one of the gradation voltage $V_3$ generated at the D/A converter C3*a*, the gradation voltage $V_{12}$ generated at the D/A converter C6*a*, the average gradation voltage VM based on $V_3$ and $V_{12}$, and the weighted average gradation voltage VW based on $V_3$ and $V_{12}$, and then supplies the selected voltage to the amplifier A9 as the gradation voltage $V_9$.

The amplifiers A1 to A12 apply, to the data lines $D_1$ to $D_{12}$ of the display panel 20, the gradation voltages $G_1$ to $G_{12}$ obtained by individually amplifying the gradation voltages $V_1$ to $V_{12}$ supplied from the D/A converter C1*a* to C6*a* and the gradation voltage interpolation circuits KS1*a* to KS6*a*.

As described above, the configuration shown in FIG. 8 is configured to perform the gradation voltage conversion by the D/A converters (C1*a* to C6*a*) only on the video data pieces (for example, $SD_1$ to $SD_3$ and $SD_{10}$ to $SD_{12}$) corresponding to the pixels PX that are disposed at intervals of two on one horizontal scan line. This allows for producing the gradation voltages (for example, $V_1$ to $V_3$ and $V_{10}$ to $V_{12}$) corresponding to the video data pieces. Then, by the interpolation based on each gradation voltage generated by the D/A converter, the gradation voltages (for example, $V_4$ to $V_9$) corresponding to other video data pieces (for example, $SD_4$ to $SD_9$) are obtained.

Therefore, by employing the configuration shown as the gradation voltage output part 124 in FIG. 8, (m/3) D/A converters may be provided for one horizontal scan line of m pieces of pixel data $SD_1$ to $SD_m$. Thus, when compared with the case where employed is the configuration shown in FIG. 4 that requires (m/2) D/A converters for one horizontal scan line of m pieces of pixel data $SD_1$ to $SD_m$, it is possible to reduce the circuit size of the D/A converter provided in the data driver 12. This makes it possible to reduce the chip size of the data driver 12 and reduce the power consumption and the amount of generated heat.

In the aforementioned embodiment, the piece of video data (PD, QD, LD, SD) have eight bits. However, the number of bits of the piece of video data is not limited to eight bits.

The display device shown in FIG. 1 is intended to receive the input video data VD of a series of video data pieces each indicative of the brightness level corresponding to each pixel, but may also receive the input video data VD as below.

That is, in the series of video data pieces of the input video data VD, the video data pieces corresponding to the pixel PX that is not to be subjected to the gradation voltage conversion by the aforementioned D/A converter are to be received after being changed to pieces of gradation voltage specifying data. Note that the piece of gradation voltage specifying data is to specify the gradation voltage to be selected by the aforementioned selector 52 or 52*a*.

Figure 9:
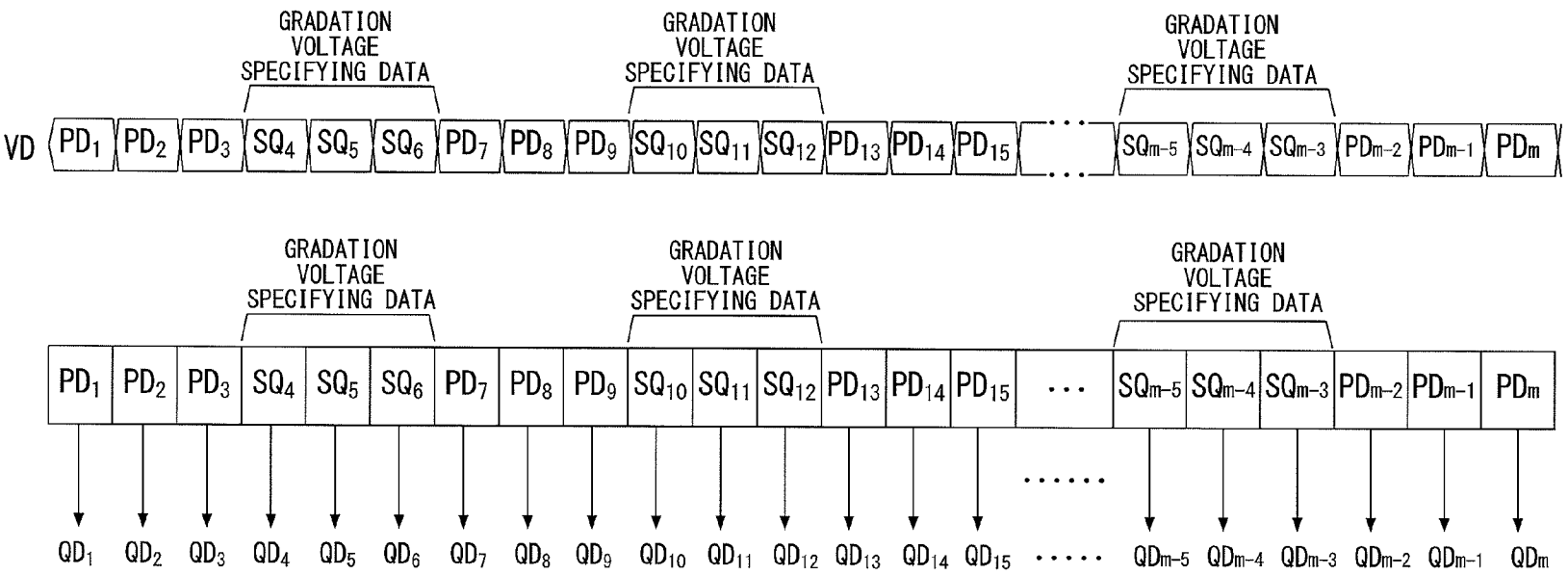
FIG. 9 is a view illustrating another example of the format of input video data VD and the operation of a shift register 121.

For example, in the case where the configuration shown in FIG. 4 is employed as the gradation voltage output part 124, the input video data VD having the format shown in FIG. 9 is to be entered to the display device shown in FIG. 1.

The input video data VD shown in FIG. 9 is provided with a series of video data $PD_1$ to $PD_3$, $PD_7$ to $PD_9$, $PD_{13}$ to $PD_{15}$, . . . , and $PD_{m-2}$ to $PD_m$, each being made up of, for example, eight bits, corresponding to each odd-numbered pixel PX (the first pixel group) on a horizontal scan line of the display panel 20. The input video data VD is also provided with a series of gradation voltage specifying data $SQ_4$ to $SQ_6$, $SQ_{10}$ to $SQ_{12}$, . . . , and $SQ_{m-5}$ to $PD_{m-3}$, each being made up of, for example, two bits, corresponding to each even-numbered pixel PX (the second pixel group) on the horizontal scan line.

When the input video data VD shown in FIG. 9 is entered, the shift register 121 of the data driver 12 supplies, to the data latch 122 as the video data $QD_1$ to $QD_m$, a series of video data pieces (PD) and pieces of gradation voltage specifying data (SQ) resulting from the input video data VD each time one horizontal scan line of input video data VD is completely acquired.

This allows the D/A converter (for example, C1 to C6) of the gradation voltage output part 124 to convert, into an analog voltage value, each piece of video data (for example, $SD_1$ to $SD_3$ and $SD_7$ to $SD_9$) corresponding to each pixel PX belonging to the aforementioned first pixel group and thereby acquire a gradation voltage (for example, $V_1$ to $V_3$ and $V_7$ to $V_9$) having the voltage value.

By the interpolation based on each gradation voltage generated by the D/A converter, the gradation voltage interpolation circuit (for example, KS1 to KS6) of the gradation voltage output part 124 acquires a gradation voltage ($V_4$ to $V_6$ and $V_{10}$ to $V_{12}$) corresponding to each piece of video data belonging to the second video data group. That is, the average computation part (51) of the gradation voltage interpolation circuit determines, as an average gradation voltage, the average value of the first gradation voltage generated by the D/A converter on the basis of one of the video data pieces belonging to the first pixel group and the second gradation voltage generated by the D/A converter on the basis of another of the video data pieces belonging to the first pixel group. The weighted average computation part (53) of the gradation voltage interpolation circuit determines the weighted average of the first gradation voltage and the second gradation voltage as a weighted average gradation voltage. Then, on the basis of the pieces of gradation voltage selection data corresponding to the pixels belonging to the second pixel group, the selector (52) of the gradation voltage interpolation circuit selects one of the first gradation voltage, the second gradation voltage, the average gradation voltage, and the weighted average gradation voltage, and then outputs the selected voltage as the gradation voltage corresponding to the pixels belonging to the second pixel group.

This application is based on Japanese Patent Application No. 2014-106075 which is herein incorporated by reference.

What is claimed is:

1. A display panel drive device for receiving input video data signals each including a series of video data pieces respectively representing brightness levels of pixels aligned with each other along a single horizontal scan line and for applying gradation voltages respectively corresponding to the video data pieces to a display panel, each of the video data pieces belonging to either one of first and second video data groups which are different from each other, said display panel drive device comprising:

a D/A converter configured to convert each of the video data pieces belonging to said first video data group into a first analog gradation voltage; and a gradation voltage interpolation circuit configured to obtain a second analog gradation voltage each corresponding to the video data pieces belonging to said second video data group by interpolation based on the first analog gradation voltages respectively corresponding to at least two of the pixels.

2. The display panel drive device according to claim 1, wherein said first video data group includes the video data pieces corresponding to pixels disposed at intervals of k (k is a natural number) in an array of pixels disposed side by side along said horizontal scan line of said display panel.

3. The display panel drive device according to claim 2, wherein said gradation voltage interpolation circuit includes:

an average computation part for determining, as an average gradation voltage, an average value of a first gradation voltage generated by said D/A converter on the basis of one piece of the video data belonging to said first video data group and a second gradation voltage generated by said D/A converter on the basis of another piece of the video data which belongs to said first video data group and is different from said one piece of the video data; and a selector for selecting one of said first gradation voltage, said second gradation voltage, and said average gradation voltage on the basis of the video data pieces belonging to said second video data group, and then outputting the selected voltage as the gradation voltage corresponding to the video data pieces belonging to said second video data group.

4. The display panel drive device according to claim 3, further comprising a weighted average computation part for determining a weighted average of said first gradation voltage and said second gradation voltage as a weighted average gradation voltage, and wherein said selector selects one of said first gradation voltage, said second gradation voltage, said average gradation voltage, and said weighted average gradation voltage on the basis of the video data pieces belonging to said second video data group, and then outputs the selected voltage as the gradation voltage corresponding to the video data pieces belonging to said second video data group.

5. The display panel drive device according to claim 2, wherein in an array of pixels disposed side by side along the horizontal scan line, the video data pieces corresponding to odd-numbered pixels belong to said first video data group, and the video data pieces corresponding to even-numbered pixels belong to said second video data group.

6. The display panel drive device according to claim 3, wherein in an array of pixels disposed side by side along the horizontal scan line, the video data pieces corresponding to odd-numbered pixels belong to said first video data group, and the video data pieces corresponding to even-numbered pixels belong to said second video data group.

7. The display panel drive device according to claim 4, wherein in an array of pixels disposed side by side along the horizontal scan line, the video data pieces corresponding to odd-numbered pixels belong to said first video data group, and the video data pieces corresponding to even-numbered pixels belong to said second video data group.

8. The display panel drive device according to claim 1, wherein:

each of the pixels of said display panel includes three display cells being responsible for red, green, and blue colors, respectively, the three display cells being disposed side by side along the horizontal scan line;

the video data pieces corresponding to each pixel include the piece of video data responsible for a red component, the piece of video data responsible for a green color component, and the piece of video data responsible for a blue component; and by interpolation based on said first gradation voltage and said second gradation voltage generated by said D/A converter on the basis of each of the video data pieces responsible for the same color component, said gradation voltage interpolation circuit provides the gradation voltage corresponding to the video data pieces responsible for the same color component and belonging to said second video data group.

9. The display panel drive device according to claim 2, wherein:

each of the pixels of said display panel includes three display cells being responsible for red, green, and blue colors, respectively, the three display cells being disposed side by side along the horizontal scan line;

the video data pieces corresponding to each pixel include the piece of video data responsible for a red component of the piece of video data responsible for a green color component, and the piece of video data responsible for a blue component; and by interpolation based on said first gradation voltage and said second gradation voltage generated by said D/A converter on the basis of each of the video data pieces responsible for the same color component, said gradation voltage interpolation circuit provides the gradation voltage corresponding to the video data pieces responsible for the same color component and belonging to said second video data group.

10. The display panel drive device according to claim 3, wherein:

each of the pixels of said display panel includes three display cells being responsible for red, green, and blue colors, respectively, the three display cells being disposed side by side along the horizontal scan line;

the video data pieces corresponding to each pixel include the piece of video data responsible for a red component, the piece of video data responsible for a green color component, and the piece of video data responsible for a blue component; and by interpolation based on said first gradation voltage and said second gradation voltage generated by said D/A converter on the basis of each of the video data pieces responsible for the same color component, said gradation voltage interpolation circuit provides the gradation voltage corresponding to the video data pieces responsible for the same color component and belonging to said second video data group.

11. The display panel drive device according to claim 4, wherein:

each of the pixels of said display panel includes three display cells being responsible for red, green, and blue color, respectively, the three display cells being disposed side by side along the horizontal scan line;

the video data pieces corresponding to each pixel include the piece of video data responsible for a red component, the piece of video data responsible for a green color component, and the piece of video data responsible for a blue component; and by interpolation based on said first gradation voltage and said second gradation voltage generated by said D/A converter on the basis of each of the video data pieces responsible for the same color component, said gradation voltage interpolation circuit provides the gradation voltage corresponding to the video data pieces responsible for the same color component and belonging to said second video data group.

12. The display panel drive device according to claim 5, wherein:

each of the pixels of said display panel includes three display cells being responsible for red, green, and blue colors, respectively, the three display cells being disposed side by side along the horizontal scan line;

the video data pieces corresponding to each pixel include the piece of video data responsible for a red component, the piece of video data responsible for a green color component, and the piece of video data responsible for a blue component; and by interpolation based on said first gradation voltage and said second gradation voltage generated by said D/A converter on the basis of each of the video data pieces responsible for the same color component, said gradation voltage interpolation circuit provides the gradation voltage corresponding to the video data pieces responsible for the same color component and belonging to said second video data group.

13. A display panel drive device for receiving input video data that has a series of video data pieces each indicative of a brightness level of each pixel and then applying gradation voltage corresponding to each of the video data pieces to said display panel, wherein, when a plurality of pixels disposed side by side on a horizontal scan line of said display panel are classified into a first pixel group and a second pixel group different from said first pixel group, said input video data includes a plurality of video data pieces each corresponding to each of the pixels belonging to said first pixel group and pieces of gradation voltage selection data each corresponding to each of the pixels belonging to said second pixel group, said display panel drive device comprising:

a D/A converter for converting each of the video data pieces each corresponding to each of the pixels belonging to said first pixel group into an analog voltage as a gradation voltage corresponding to said first pixel group;

an average computation part for determining, as an average gradation voltage, an average value of a first gradation voltage generated by said D/A converter on the basis of one piece of the video data belonging to said first pixel group and a second gradation voltage generated by said D/A converter on the basis of another piece of the video data different from the one piece of the video data belonging to said first pixel group;

a weighted average computation part for determining, as a weighted average gradation voltage, a weighted average of said first gradation voltage and said second gradation voltage; and a selector for selecting one of said first gradation voltage, said second gradation voltage, said average gradation voltage, and said weighted average gradation voltage on the basis of the pieces of the gradation voltage selection data corresponding to the pixels belonging to said second pixel group, and then outputting the selected voltage as the gradation voltage corresponding to the pixels belonging to said second pixel group.

14. A display panel drive method of receiving input video data that has a series of video data pieces respectively representing brightness levels of pixels aligned with each other along a single horizontal scan line and then applying gradation voltages respectively corresponding to the video data pieces to a display panel, each of the video data pieces belonging to either one of first and second video data groups which are different from each other, said display panel drive method comprising:

converting each of the video data pieces belonging to said first video data group into a first analog gradation voltage; and obtaining, by interpolation based on the first analog gradation voltages corresponding respectively to at least two of the pixels, a second analog gradation voltage each corresponding to the video data pieces belonging to said second video data group.

* * * * *